US009572380B2

(12) United States Patent
Sizemore

(10) Patent No.: US 9,572,380 B2
(45) Date of Patent: Feb. 21, 2017

(54) NON-ENCIRCLING COMFORT PAD SYSTEM

(71) Applicant: Brent Douglas Sizemore, Walland, TN (US)

(72) Inventor: Brent Douglas Sizemore, Walland, TN (US)

( * ) Notice: Subject to any disclaimer, the term of this patent is extended or adjusted under 35 U.S.C. 154(b) by 83 days.

(21) Appl. No.: 13/959,574

(22) Filed: Aug. 5, 2013

(65) Prior Publication Data

US 2014/0033412 A1 Feb. 6, 2014

Related U.S. Application Data

(60) Provisional application No. 61/679,304, filed on Aug. 3, 2012.

(51) Int. Cl.

| | |
|---|---|
| ***A41D 13/00*** | (2006.01) |
| ***A41D 13/06*** | (2006.01) |
| ***A41D 13/08*** | (2006.01) |
| ***A41D 13/05*** | (2006.01) |

(52) U.S. Cl.

CPC ..... *A41D 13/065* (2013.01); *A41D 13/0556* (2013.01); *A41D 13/08* (2013.01)

(58) Field of Classification Search

CPC .... A41D 13/015; A41D 13/065; A41D 13/08; A41D 13/05; A41D 13/06; A41D 13/0543;A41D 13/00; A41D 13/055; A41D 13/0556; A63B 71/12; A63B 71/1225; A63B 71/08; A63B 2071/125

USPC ..... 2/455, 16, 23, 24, 62

See application file for complete search history.

(56) References Cited

U.S. PATENT DOCUMENTS

| | | | | |
|---|---|---|---|---|
| 2,561,872 | A * | 7/1951 | Krinick | 2/24 |
| 4,561,123 | A * | 12/1985 | Hull | 2/23 |
| 5,592,689 | A * | 1/1997 | Matthews | 2/23 |
| 7,380,283 | B1 * | 6/2008 | Dumont | 2/23 |
| 7,712,150 | B2 * | 5/2010 | Pardillo et al. | 2/23 |
| 7,945,968 | B2 * | 5/2011 | Johnson | 2/23 |
| 8,656,514 | B2 * | 2/2014 | Neuron | 2/23 |
| 2006/0032026 | A1 * | 2/2006 | Schoening et al. | 24/66.1 |
| 2008/0104742 | A1 * | 5/2008 | Alperin et al. | 2/321 |
| 2009/0083901 | A1 * | 4/2009 | Pardillo et al. | 2/455 |

* cited by examiner

*Primary Examiner* — Khaled Annis
(74) *Attorney, Agent, or Firm* — Merchant & Gould

(57) ABSTRACT

A non-encircling comfort pad system that allows the user to selectively attach a pad to and detach the pad from the article of clothing is disclosed. The non-encircling comfort pad system includes a pad having a pad fastener part and a mount fastener part that is attached to the article of clothing. The pad fastener part is configured to engage the mount fastener part such that the pad is held to the article of clothing without requiring any encirclement of the protected body part.

19 Claims, 6 Drawing Sheets

NON-ENCIRCLING COMFORT PAD SYSTEM

CROSS REFERENCE TO RELATED APPLICATIONS

This application claims the benefit of U.S. Provisional Application No. 61/679,304, filed Aug. 3, 2012.

BACKGROUND

Many people choose to wear pads while engaging in various activities to protect themselves from injuries. Types of pads can include knee or elbow pads for people whose activities require them to be close to the ground or shoulder pads for those whose activities require them to receive loads or impacts on their shoulders. Conventional pads require the user to place straps or bands around portions of their bodies to hold the pads in place. These straps and bands can be difficult to wear. If the strap or band is too loose, the pad will tend to slide out of place. A band or strap that is too tight can cut off the wearer's circulation.

BRIEF SUMMARY

A non-encircling comfort pad system provides a mount that allows the user to selectively attach a pad to and detach the pad from the article of clothing. The mount includes a pad fastener part that is attached to the pad and a mount fastener part that is attached to the article of clothing, thereby allowing the pad fastener part to be connected to the mount fastener part such that the pad is held to the article of clothing. The portion of the user's body protected by the non-encircling comfort pad system is thereby protected without requiring any encirclement of the protected body part.

DETAILED DESCRIPTION

The non-encircling comfort pad system disclosed herein provides a pad and a mount that allows the user to selectively attach the pad to and detach the pad from an article of clothing. The mount includes a pad fastener part that is attached to the pad and a mount fastener part that is attached to the article of clothing. When the mount fastener part is attached to the article of clothing, the pad fastener part can be connected to the mount fastener part by a mechanical or magnetic bond such that the pad is attached to the article of clothing. The portion of the user's body that is desired to be protected by the non-encircling comfort pad system (the "protected body part") is thereby protected without requiring any encirclement of the protected body part. With no straps or bands, the inherent problems associated with straps or bands are necessarily reduced or eliminated.

Figure 1:
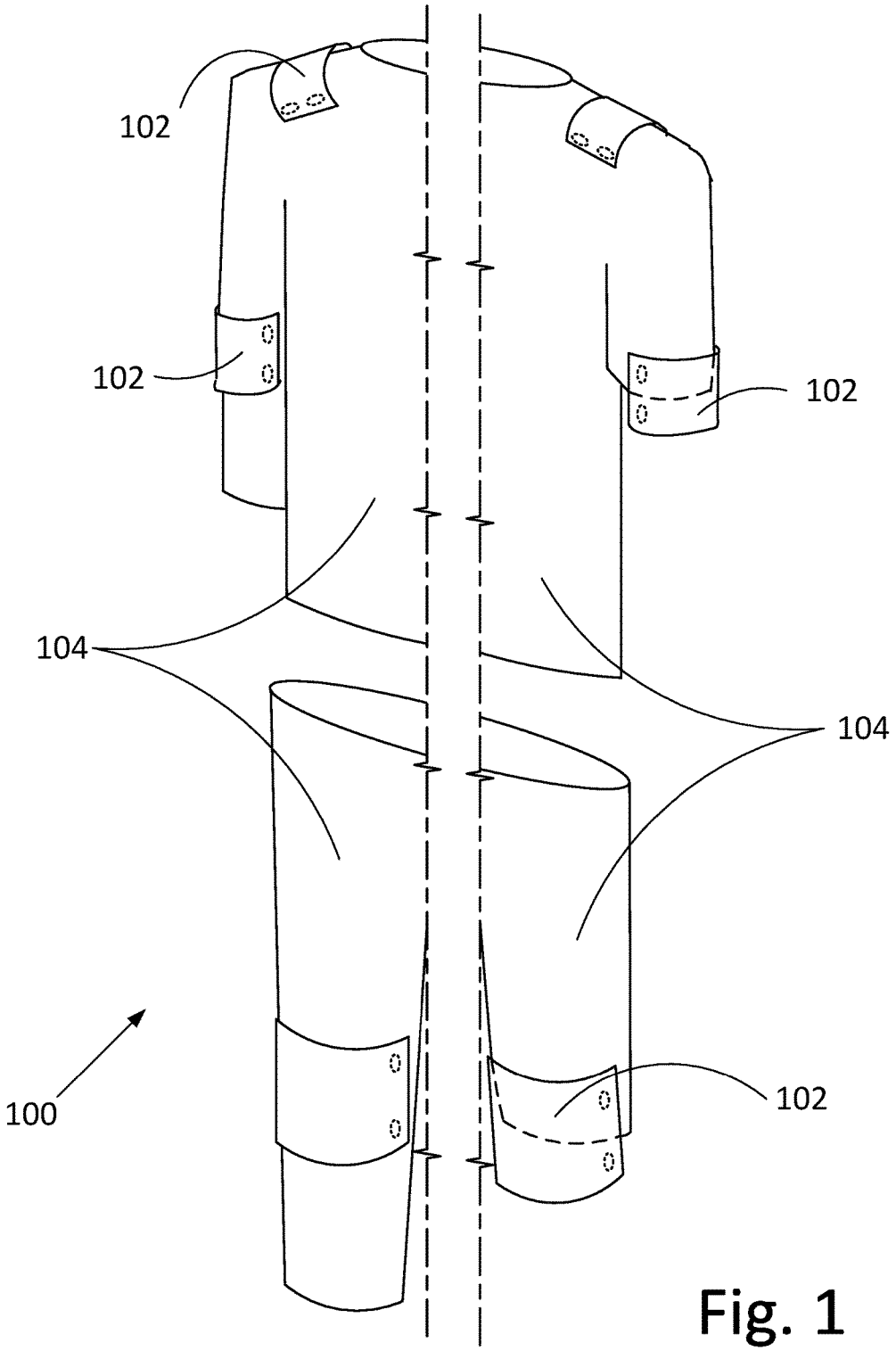
FIG. 1 illustrates one embodiment of the non-encircling comfort pad system attached to various articles of clothing.

FIG. 1 illustrates one embodiment of the non-encircling comfort pad system in use on various articles of clothing. The pads 102 are attached to the articles of clothing 104 at typical locations requiring protection including, but are not limited to, the knees, elbows, and shoulders. In some cases, the article of clothing used with the non-encircling comfort pad system 100 does not extend to or beyond the protected body part, such as with short sleeved shirts or shorts.

Figure 2:
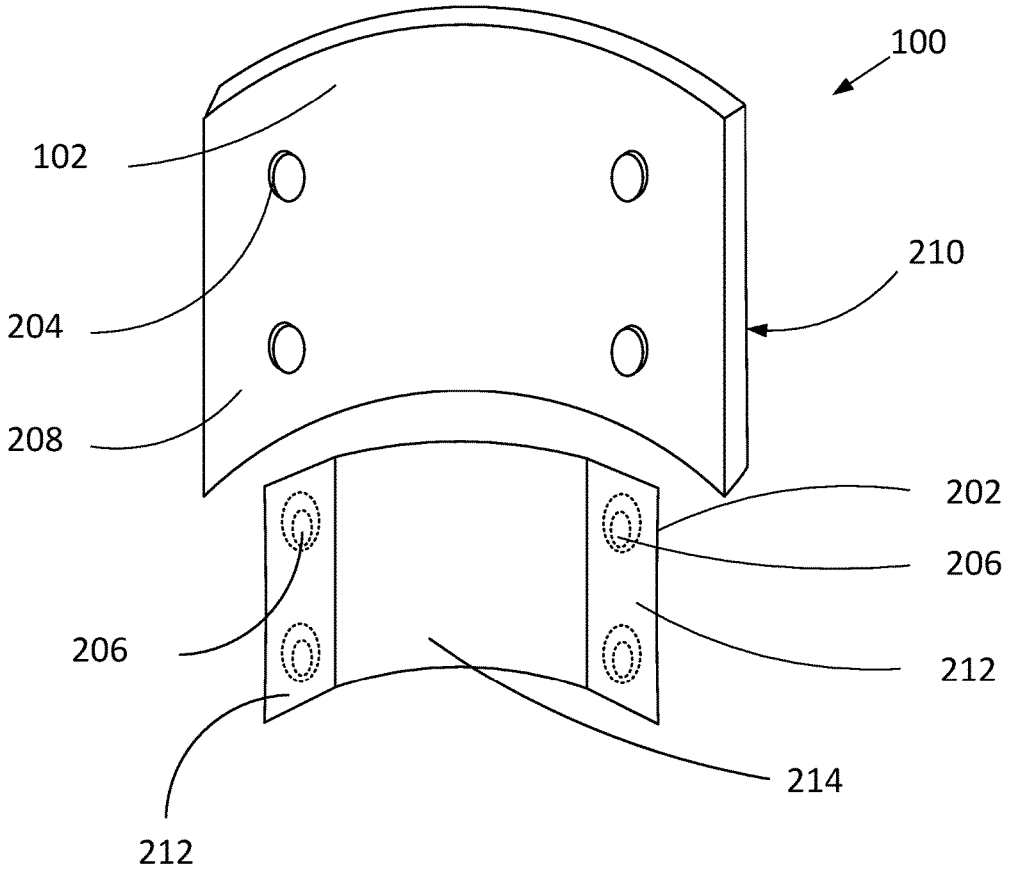
FIG. 2 illustrates an exploded view of one embodiment of the non-encircling comfort pad system.

FIG. 2 illustrates one embodiment of the non-encircling comfort pad system 100. The non-encircling comfort pad system 100 includes the pad 102 and a mount 202, which is integrated with or attachable to an article of clothing. The pad 102 is made up of materials that are substantially able to deflect, distribute, and/or absorb forces including, but not limited to, fabric, foam, plastic, or metal. The pad 102 is also constructed to allow the pad 102 to flex to accommodate the shape of the user's body as well as the user's movements while the non-encircling comfort pad system 100 is in use. Because placing the pad on different parts of the body may require pads of different shapes or sizes, the shape and size of the pad 102 varies depending on the location of the protected body part.

The pad 102 connects to the mount 202 via one or more two part fasteners. The fastener parts 204 of the pad 102 cooperatively engage the corresponding fastener parts 206 on the mount 208. Each pad fastener part 204 is able to be selectively attached to or detached to the corresponding mount fastener part 206. The illustrated embodiment of the pad 102 includes four pad fastener parts 204. Because different protected body parts may require the non-encircling comfort pad system 100 to have alternate configurations, the pad fastener parts 204 can vary in number size and configuration. The pad fastener parts 204 align with one or more corresponding mount fastener parts 206.

In various embodiments, the mount fastener parts 206 are attached to, attachable to, or integrated into the article of clothing. In other embodiments, a receptacle for receiving the fastener part is attached to, attachable to, or integrated into the article of clothing. In some embodiments, the mount fastener parts 206 are carried by a patch attached to the article of clothing. The mount fastener parts 206 are located in selected positions such that when the patch is secured to the article of clothing, the fastener parts on the patch are properly aligned with the pad fastener parts on the pad.

In various embodiments, the pad fastener parts 204 are magnetically securable to corresponding mount fastener parts 206. In other words, one fastener part, which is a magnet, attracts the other fastener part, which is a second magnet or a non-magnetized magnetic material. The strength of the magnetic bond between the pad fastener part 204 and the mount fastener part 206 varies based on the types and/or number of magnetic materials (i.e. permanent magnets, rare earth magnets, and nonmagnetized magnetic materials) used for the fastener parts 204, 206. In an alternate embodiment, the pad fastener part 204 is the stud portion of a snap fastener that is able to be selectively attached to or removed from a socket serving as the mount fastener part 206. In other embodiments, the pad fastener parts 204 and mount fastener parts 206 include other types of two-part fasteners including, but not limited to, buttons, ties, locking tabs, or other fasteners.

In the illustrated embodiments, the pad fastener parts 204 are located on the inner surface 208 of the pad 102 (i.e., the surface facing the user). In an alternate embodiment, the pad fastener parts 204 are located on the outer surface 210 of the pad. In another alternate embodiment, the pad fastener parts 204 are attached to the pad 102 with extension members that extend the pad fastener part 204 to meet the corresponding mount fastener part 206.

In one embodiment, the mount 104 includes one or more patches 212 for attachment to an article of clothing. The patches 212 are made of a substantially flexible material that flexes with the article of clothing. The arrangement of the patches 212 on the article of clothing 104 are at locations that correspond to the locations of the pad fastener parts 204. The patches 212 are attachable to an article of clothing by any of a variety of methods including, but not limited to, hook and loop, stitching, pins, heat reactive adhesives, or fusing tape.

In the illustrated embodiment, the pad 102 has a curved shape to accommodate the curved shape of the user's body. Also, the article of clothing 104, while being worn, will substantially conform to the curvature of the user's body. Because of this curvature, setting the mount fastener parts 206 in the proper location of the article of clothing 104 may be difficult as the article of clothing 104 will likely be laid flat when setting the location of and attaching the mount fastener parts 206 to the article of clothing 104. If the mount fastener parts 206 are not attached in the proper location on the article of clothing 104, the pad may not be able to be attached to the article of clothing or may not properly cover the protected body part. Alternatively, the bond between the pad fastener parts 204 and the corresponding mount fastener parts 206 may be weakened resulting in the pad being easily (and unintentionally) detached or the article of clothing may bunch or wrinkle under the pad resulting in discomfort to the user.

To set the mount fastener parts 206 in the desired location and to allow the mount fastener parts 206 to properly connect to the pad fastener parts 204 on the curved pad 102, the patch 212 includes an integrated guide mechanism 214. The integrated guide mechanism 214 is sized to separate the mount fastener parts 206 by the same arcuate distance that separates the corresponding pad fastener parts 204. When attached to the article of clothing 104 according to the predetermined configuration set by the integrated guide mechanism 214, the mount fastener parts 206 will be positioned to properly engage the corresponding pad fastener parts 204. In various embodiments, the integrated guide mechanism 214 can be removed from the patches 212 and from the article of clothing 104 after the patches 212 are secured.

Figure 3:
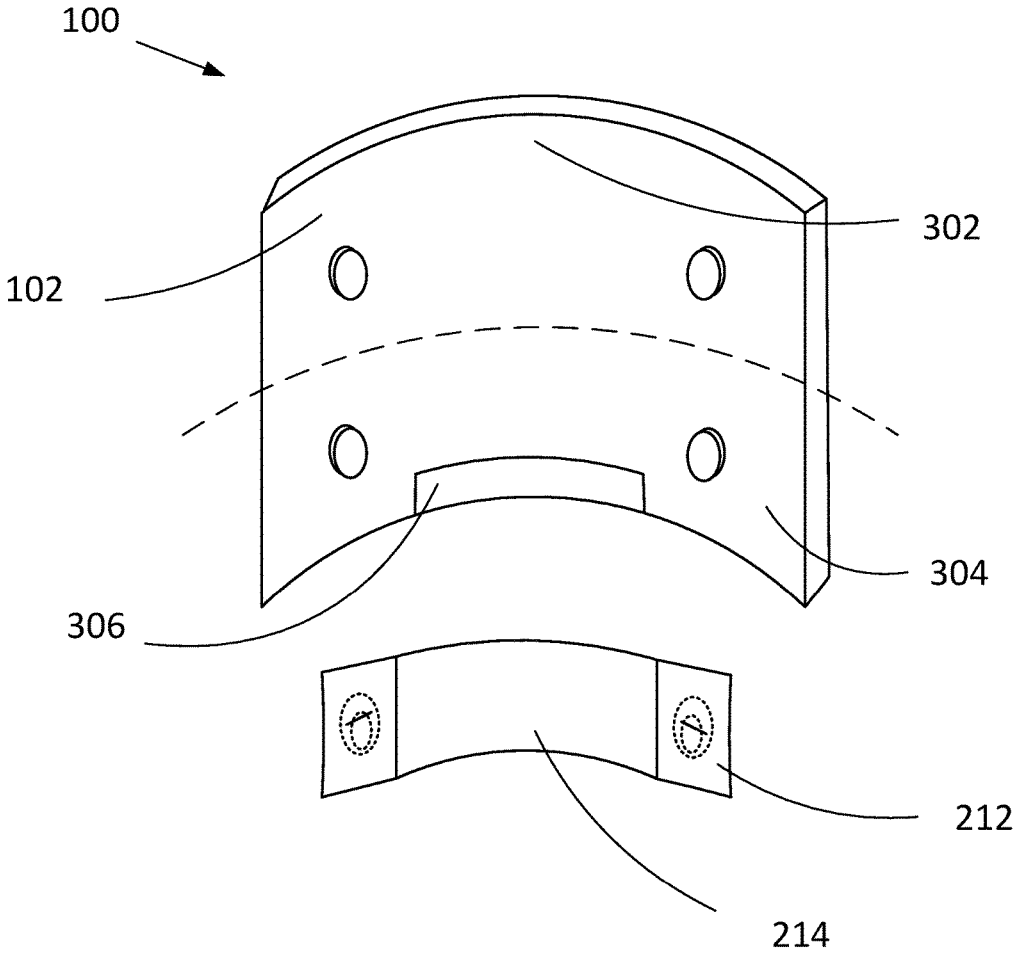
FIG. 3 illustrates one embodiment of a pad from the non-encircling comfort pad system used with an article of clothing that does not extend to or beyond the protected body part.

FIG. 3 illustrates one embodiment of non-encircling comfort pad system with a pad optimized for use with an article of clothing that does not extend to or beyond the protected body part. The pad fastener parts 204 on the top portion 302 fasten to the corresponding mount fastener parts 206 locate above the protected body part. The bottom portion 304 includes at least one weight 306 to pull the pad downward and generally maintain the position of the pad 102 from moving in a manner that would expose the protected body part. In some embodiments, the pad fastener parts 204 on the bottom portion 304 of the pad 102 are omitted, removable, recessed (e.g., flush mounted) for comfort.

Figure 4:
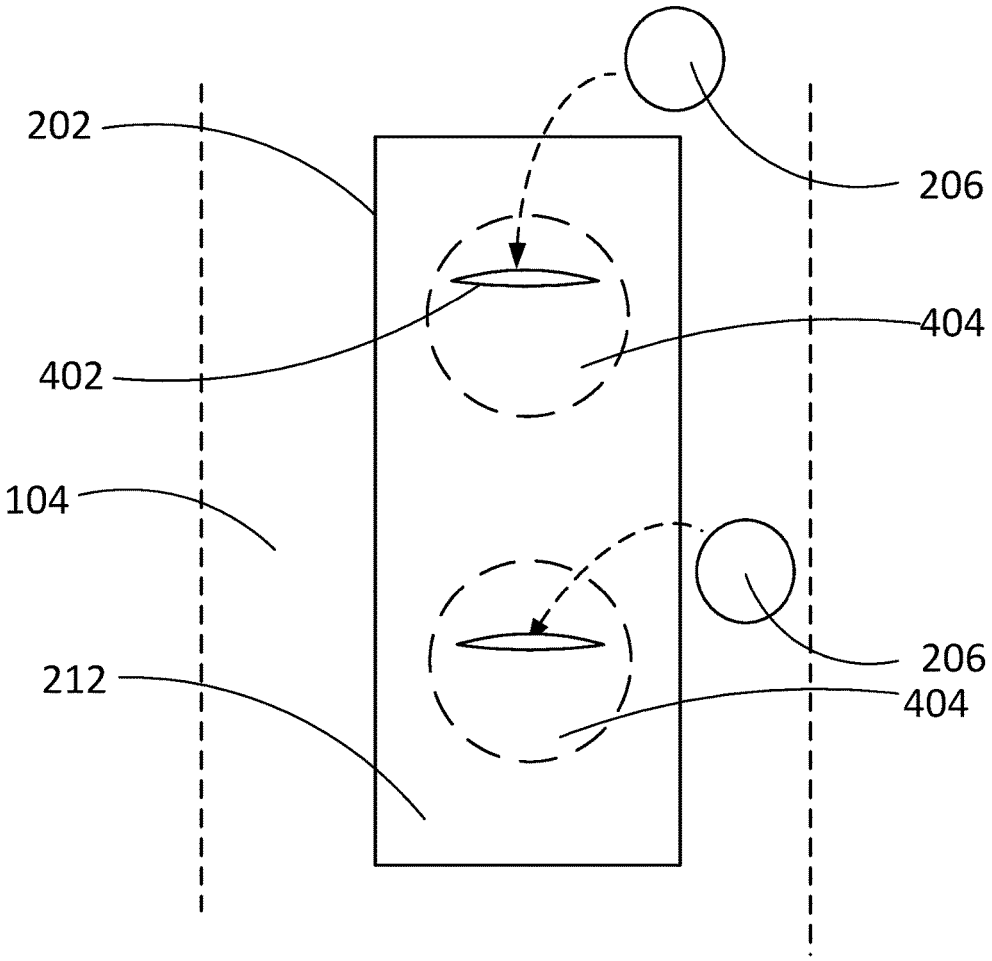
FIG. 4 illustrates a detail view of the patch.

FIG. 4 illustrates one embodiment of the mount allowing the mount fastener parts 206 to be inserted and removed as desired. The mount defines an opening 402 providing access to a receptacle 404 configured to hold the mount fastener parts 206. The mount fastener part 206 is selectively inserted and removed from the receptacle via the opening. In one embodiment, the mount forms the receptacle. In an alternate embodiment, the receptacle is formed by an elastic member secured to the mount and forming a pouch that holds conforms to the installed mount fastener part 206. In yet another embodiment, the receptacle is cooperatively formed by the mount and the article of clothing to which it is attached.

In various embodiments, the mount 202 includes a selectively operable (i.e., non-permanent) closure to secure the fastener parts in the receptacle. Such non-permanent, reusable closures include, but are not limited to, flaps, buttons, magnets, zippers, or hook and loop. The ability to change the mount fastener parts 206 allows the fastener parts to be moved between different articles of clothing and is particularly advantageous when the mount fastener parts 206 are relatively expensive (e.g., rare earth magnets) and/or when the bond strength needs to be frequently adjusted for different applications. For example, the user may desire to use one set of pads with several different articles of clothing for times when the article of clothing needs to be laundered or replaced and when different articles of clothing are desired for different jobs or working conditions (e.g., weather). To accommodate these possibilities, without requiring the user to obtain an entirely new non-encircling comfort pad system 100, an alternate embodiment of the non-encircling comfort pad system 100 includes only the mount fastener part 206 including the patch 212 and the integrated guide mechanism 214. In other embodiments, the receptacle is permanently sealed preventing the non-destructive removal of the fastener parts from the article of clothing 104 once installed.

Figure 5:
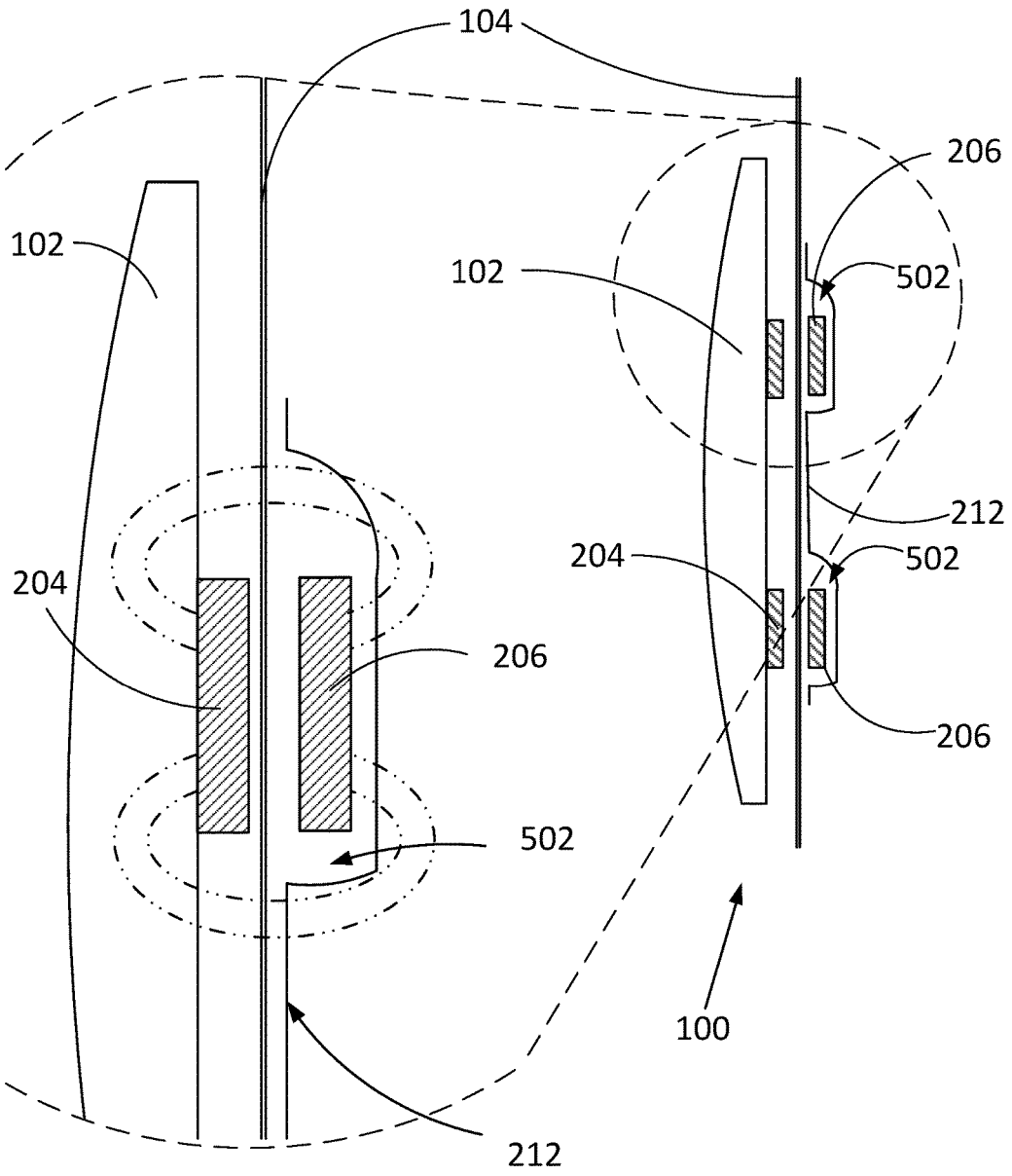
FIG. 5 illustrates a section view of the non-encircling comfort pad system while connected.

FIG. 5 illustrates a section view of one embodiment of the non-encircling comfort pad system in use on the article of clothing 104. In the illustrated embodiment, the fastener parts are magnetic materials. The first magnetic material is attached to the pad 102. The second magnetic material is located within the receptacle 502. In some embodiments, the receptacle 502 has sufficient volume for the second magnetic material move around and reorient itself while in the receptacle 502 as the second magnetic material comes into close proximity to the first magnetic material. This is to permit the polarity of the magnetic materials to align to be in magnetic attraction.

When the mount described in this embodiment is attached to the article of clothing 104 and the mount fastener part 206 is engaged to the pad fastener part 204, the non-encircling comfort pad 102 is held substantially in place on the article of clothing 104 and also permits the non-encircling comfort pad 102 to accommodate the user's movements.

In another alternate embodiment, articles of clothing, including, but not limited to, shirts, pants, or shorts, may be manufactured to include one or more mount fastener parts 206 such that the user can purchase clothing with the mount fastener parts 206 pre-attached and ready for use with the pads 204 of the non-encircling comfort pad system 100 to receive the user's prepurchased pads and protect portions of the user's body that the user desires to protect.

Figure 6:
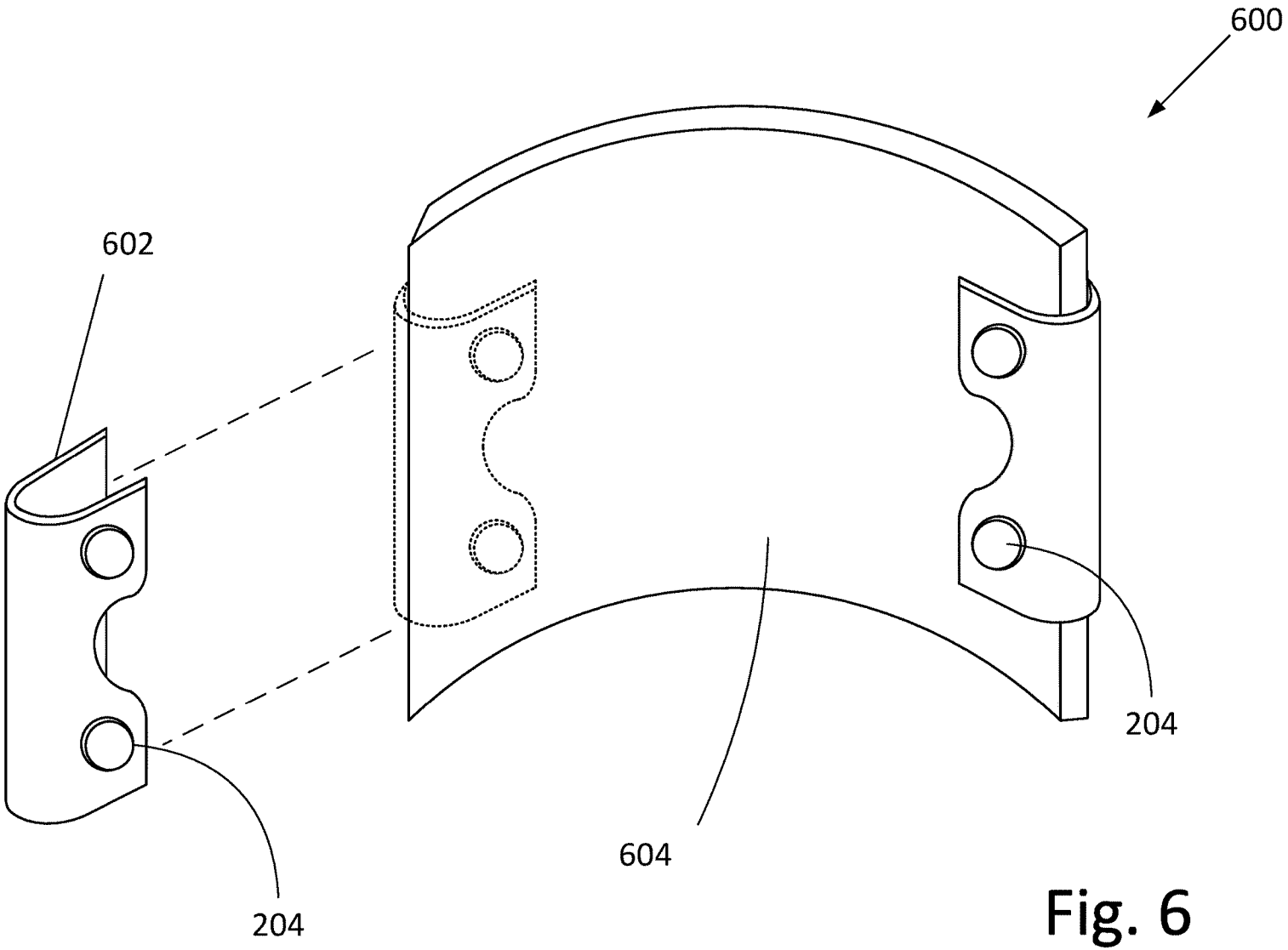
FIG. 6 illustrates one embodiment of a clip-on attachment converting a conventional pad for use in the non-encircling comfort pad system.

FIG. 6 illustrates a re-attachable clip-on attachment for utilizing a conventional pad with the non-encircling comfort pad system. The re-attachable clip-on attachment 600 includes a clip 602 and at least one pad fastener part 204. The clip 602 is designed to securely attach to a conventional pad 604, but can be removed when desired. In various embodiments, the clip 602 includes two opposing walls configured to receive the conventional pad 604 there between. Specifically, the opposing walls are arranged such that when the pad 604 is received there between the opposing walls clamp to the pad 604 and frictionally cling to the pad 604. By attaching the re-attachable clip-on attachment 600 to a conventional pad, the conventional pad can be utilized by the non-encircling comfort pad system 100. Further, the conventional pads 604 can continue to be used with straps when the clip-on attachment 600 is removed. The illustrated embodiment of the clip-on attachment 600 includes two pad fastener parts 204. In one embodiment, the two pad fastener parts 204 are magnetic materials that are fixedly attached to the outer surface of the clip-on attachment 600. When the clip-on attachment 600 is attached to a pad 604, the outer surface is exposed on the inside surface of the pad 604 such that the pad fastener part 204 can engage the mount fastener part 206.

While the non-encircling comfort pad has been described with reference to a particular embodiment thereof, those skilled in the art will be able to make various modifications to the described embodiment without departing from the true spirit and scope thereof. Such modifications include but are not limited to the number, size and configuration of the pad fastener parts and/or mount fastener parts, the configuration of the two-part fastener used, the number of patches and/or receptacles used, and the portions of the user's body that can be protected. It is intended that all combinations of elements and steps which perform substantially the same function in substantially the same way to achieve substantially the same result are within the scope of this invention.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A comfort pad for use on an article of clothing, the comfort pad comprising:

a pad having a plurality of pad fastener parts removably attached to an outer surface of the article of clothing, wherein the outer surface faces away from the wearer when the article of clothing is worn;

a plurality of mount fastener parts; and one or more separate guide mechanisms attached to an inner surface of the article of clothing, wherein the inner surface faces the wearer when the article of clothing is worn, the one or more guide mechanisms comprising a plurality of receptacles for receiving the plurality of mount fastener parts and having sufficient volume for a mount fastener part to move around, each receptacle of the plurality of receptacles having an opening for inserting and removing a mount fastener part, the plurality of receptacles being arranged on the one or more guide mechanisms such that when the one or more guide mechanisms are attached to the article of clothing, the plurality of mount fastener parts connect to the plurality of pad fastener parts without a strap encircling the article of clothing;

wherein the one or more guide mechanisms and the plurality of mount fastener parts are aligned with the inner surface of the article of clothing when the article of clothing is worn.

2. The comfort pad of claim 1, wherein the pad includes two pad fastener parts arranged at a spaced relationship such that each pad fastener part is located at an opposing side of the article of clothing when disposed on the person's clothing.

3. The comfort pad of claim 1, further comprising a patch having the plurality of receptacles defined therein to receive one of the plurality of mount fastener parts.

4. The comfort pad of claim 1, wherein the one or more guide mechanisms includes the plurality of receptacles at spaced locations corresponding to the spaced locations of the pad fastener parts on the pads.

5. The comfort pad of claim 1, wherein the mount fastener part is magnetized material.

6. The comfort pad of claim 1, wherein the mount fastener part is nonmagnetized magnetic material.

7. The comfort pad of claim 1, wherein the comfort pad extends beyond the article of clothing to protect a body part not covered by neither the article of clothing nor the guide mechanisms.

8. A comfort pad for use on a person's clothing, the comfort pad comprising:

a pad having an interior surface and an exterior surface;

one or more pad magnetic materials attached to an inner surface of the pad and removably attached to an outer surface of the article of clothing, wherein the outer surface faces away from the wearer when the article of clothing is worn;

one or more mount magnetic materials;

one or more separate guide mechanisms attached to an inner surface of the article of clothing, wherein the inner surface faces the wearer when the article of clothing is worn, the one or more guide mechanisms comprising a plurality of receptacles for receiving a plurality of mount fastener parts, each receptacle of the plurality of receptacles having an opening for inserting and removing a mount fastener part; and wherein when the pad is positioned at the one or more mount magnetic materials carried by the article of clothing, the one or more pad magnetic materials engage the one or more mount magnetic materials such that the pad is disposed on the article of clothing without requiring a strap that encircles the article of clothing;

wherein the one or more guide mechanisms and the plurality of mount magnetic materials are aligned with the inner surface of the article of clothing when the article of clothing is worn.

9. The comfort pad of claim 8, wherein the pad includes two pad magnetic materials arranged at a spaced relationship such that each pad magnetic material is located at an opposing side of the article of clothing when disposed on the article of clothing.

10. The comfort pad of claim 8, wherein the pad magnetic material is nonmagnetized magnetic material.

11. The comfort pad of claim 8, further comprising a patch having the plurality of receptacles defined therein to receive the mount fastener part.

12. The comfort pad of claim 11, wherein the patch includes a plurality of receptacles at spaced locations corresponding to the spaced locations of the pad magnetic materials on the pads.

13. The comfort pad of claim 12, wherein the receptacle is configured with a volume to permit the mount fastener part movement while in the receptacle, such that the mount fastener part is able to move to engage the one or more pad magnetic materials.

14. A comfort pad for use on an article of clothing, the comfort pad comprising:

a pad having a plurality of pad fastener parts removably attached to an outer surface of the article of clothing, wherein the outer surface faces away from the wearer when the article of clothing is worn, wherein the pad fastener parts are arranged at spaced locations on the pads;

a plurality of mount fastener parts; and one or more separate guide mechanisms attached to an inner surface of the article of clothing, wherein the inner surface faces the wearer when the article of clothing is worn, the one or more guide mechanisms comprising a plurality of receptacles for receiving the plurality of mount fastener parts, each receptacle of the plurality of receptacles having an opening for inserting and removing a mount fastener part, the plurality of receptacles being arranged on the plurality of guide mechanisms to correspond to the spaced locations of the pad fastener parts on the pads such that when the one or more guide mechanisms are attached to the article of clothing, the plurality of mount fastener parts connect to the plurality of pad fastener parts without a strap encircling the article of clothing;

wherein the one or more guide mechanisms and the plurality of mount fastener parts are aligned with the inner surface of the article of clothing when the article of clothing is worn.

15. The comfort pad of claim 14, wherein the pad includes two pad fastener parts arranged at a spaced relationship such that each pad fastener part is located at an opposing side of the article of clothing when disposed on the person's clothing.

16. The comfort pad of claim 14, wherein the pad fastener part is magnetic.

17. The comfort pad of claim 14, wherein the mount fastener part is magnetized material.

18. The comfort pad of claim 14, wherein the mount fastener part is nonmagnetized magnetic material.

19. The comfort pad of claim 14, wherein each receptacle of the plurality of receptacles is cooperatively formed by the article of clothing and a patch attached to the article of clothing without encircling the article of clothing.

* * * * *